US009090420B2

(12) United States Patent
Suzuki et al.

(10) Patent No.: US 9,090,420 B2
(45) Date of Patent: Jul. 28, 2015

(54) IMAGE FORMING SYSTEM AND RELAY APPARATUS

(71) Applicant: FUJI XEROX CO., LTD., Tokyo (JP)

(72) Inventors: Shiro Suzuki, Kanagawa (JP); Mitsuaki Kuroda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/013,287

(22) Filed: Aug. 29, 2013

(65) Prior Publication Data

US 2014/0284866 A1 Sep. 25, 2014

(30) Foreign Application Priority Data

Mar. 25, 2013 (JP) ..... 2013-061625

(51) Int. Cl.

| | |
|---|---|
| ***B65H 15/00*** | (2006.01) |
| ***B65H 5/26*** | (2006.01) |
| ***B65H 85/00*** | (2006.01) |
| ***G03G 15/00*** | (2006.01) |
| ***G03G 21/16*** | (2006.01) |
| ***B65H 1/14*** | (2006.01) |
| ***B65H 5/06*** | (2006.01) |
| ***B65H 9/00*** | (2006.01) |
| ***B65H 9/06*** | (2006.01) |

(52) U.S. Cl.

CPC .. *B65H 5/26* (2013.01); *B65H 1/14* (2013.01); *B65H 5/062* (2013.01); *B65H 9/004* (2013.01); *B65H 9/06* (2013.01); *B65H 15/00* (2013.01); *B65H 85/00* (2013.01); *G03G 15/6558* (2013.01); *G03G 21/1604* (2013.01); *B65H 2301/5144* (2013.01); *B65H 2402/10* (2013.01); *B65H 2404/144* (2013.01); *B65H 2404/1424* (2013.01); *B65H 2404/611* (2013.01); *B65H 2405/15* (2013.01); *B65H 2405/312* (2013.01); *B65H 2405/332* (2013.01); *B65H 2801/27* (2013.01); *G03G 2221/1696* (2013.01)

(58) Field of Classification Search

CPC ..... B65H 15/00; B65H 2301/333; B65H 2301/34; G03G 15/234; G03G 2215/00586; G03G 2215/0043; G03G 15/231; H04N 1/00575

USPC ..... 271/3.14, 3.19, 291, 301, 186, 65; 399/364, 401

See application file for complete search history.

(56) References Cited

U.S. PATENT DOCUMENTS

| | | | | |
|---|---|---|---|---|
| 7,904,015 | B2 * | 3/2011 | Spence et al. | 399/365 |
| 7,963,518 | B2 * | 6/2011 | Moore | 271/65 |
| 2010/0264574 | A1 * | 10/2010 | Tyson et al. | 271/3.14 |

FOREIGN PATENT DOCUMENTS

| | | |
|---|---|---|
| JP | A-2003-20137 | 1/2003 |

* cited by examiner

*Primary Examiner* — Michael McCullough
(74) *Attorney, Agent, or Firm* — Oliff PLC

(57) ABSTRACT

An image forming system includes a sheet feed apparatus that feeds a sheet; an image forming apparatus that is provided independently of the sheet feed apparatus and that includes an image-formation transport path used for transporting the sheet fed from the sheet feed apparatus and an image forming section that forms an image onto the sheet transported along the image-formation transport path; and a relay apparatus that is independently provided between the sheet feed apparatus and the image forming apparatus. The relay apparatus relays the sheet fed from the sheet feed apparatus toward the image forming apparatus and ensures a distance along which the sheet is transported from the sheet feed apparatus to the image forming apparatus.

7 Claims, 10 Drawing Sheets

IMAGE FORMING SYSTEM AND RELAY APPARATUS

CROSS-REFERENCE TO RELATED APPLICATIONS

This application is based on and claims priority under 35 USC 119 from Japanese Patent Application No. 2013-061625 filed Mar. 25, 2013.

BACKGROUND

Technical Field

The present invention relates to image forming systems and relay apparatuses.

SUMMARY

According to an aspect of the invention, there is provided an image forming system including a sheet feed apparatus that feeds a sheet; an image forming apparatus that is provided independently of the sheet feed apparatus and that includes an image-formation transport path used for transporting the sheet fed from the sheet feed apparatus and an image forming section that forms an image onto the sheet transported along the image-formation transport path; and a relay apparatus that is independently provided between the sheet feed apparatus and the image forming apparatus. The relay apparatus relays the sheet fed from the sheet feed apparatus toward the image forming apparatus and ensures a distance along which the sheet is transported from the sheet feed apparatus to the image forming apparatus.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail below with reference to the appended drawings.

Figure 1:
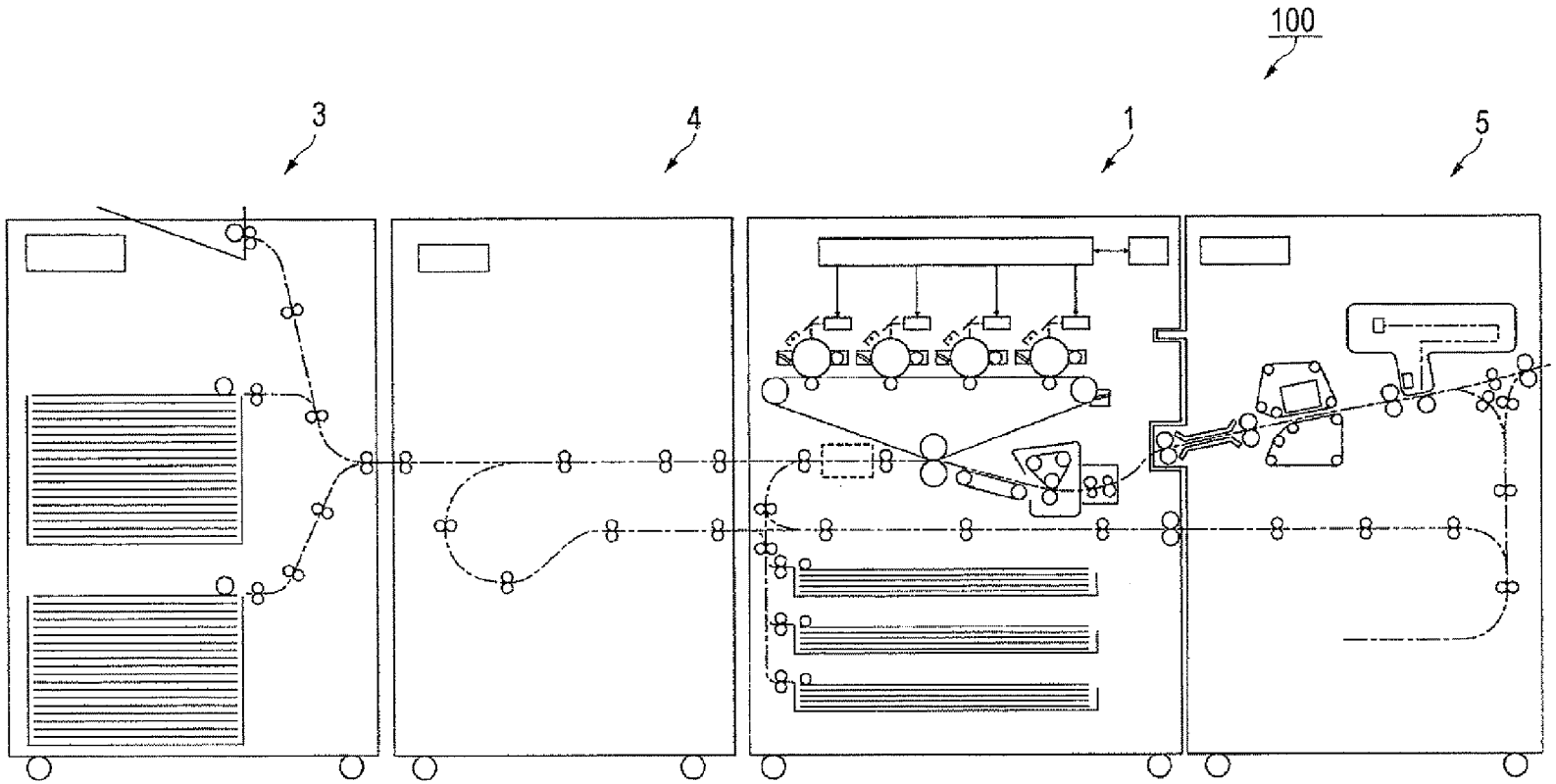
FIG. 1 illustrates the overall configuration of an image forming system to which an exemplary embodiment is applied.

FIG. 1 illustrates the overall configuration of an image forming system 100 to which the exemplary embodiment is applied.

The image forming system 100 shown in FIG. 1 includes an image forming apparatus 1 that forms a color toner image onto a sheet P by, for example, electrophotography, a sheet feed apparatus 3 that holds a large number of sheets P and feeds the sheets P in a one-by-one manner, a sheet transport apparatus 4 that transports each sheet P fed from the sheet feed apparatus 3 toward the image forming apparatus 1, and a sheet processing apparatus 5 that performs a predetermined process on the sheet P having the toner image formed thereon by the image forming apparatus 1.

Although the image forming apparatus 1 that forms an image by electrophotography is described as an example in this exemplary embodiment, the image forming apparatus 1 may alternatively be, for example, an inkjet printer.

Furthermore, although the sheet processing apparatus 5 that performs, for example, cooling on a sheet P is described as an example, the sheet processing apparatus 5 may include a binding device that performs a binding process on a stack of sheets P having images formed thereon or a punching device that performs a hole-punching process, so long as the apparatus is configured to perform a predetermined process on a sheet P having an image formed thereon.

The image forming apparatus 1 may be used alone. However, in this exemplary embodiment, the sheet feed apparatus 3, the sheet transport apparatus 4, and the sheet processing apparatus 5 are connected as additional apparatuses (so-called optional apparatuses) to the image forming apparatus 1. Furthermore, although the sheet feed apparatus 3, the sheet transport apparatus 4, and the sheet processing apparatus 5 are all connected to the image forming apparatus 1 as an example shown in FIG. 1, any one or more of the sheet feed apparatus 3, the sheet transport apparatus 4, and the sheet processing apparatus 5 may be connected to the image forming apparatus 1. Moreover, the image forming apparatus 1 may be connected to an apparatus other than the sheet feed apparatus 3, the sheet transport apparatus 4, and the sheet processing apparatus 5.

The near side and the far side of the image forming system 100 shown in FIG. 1 may sometimes be referred to as "front side" and "rear side", respectively.

Image Forming Apparatus 1

Figure 2:
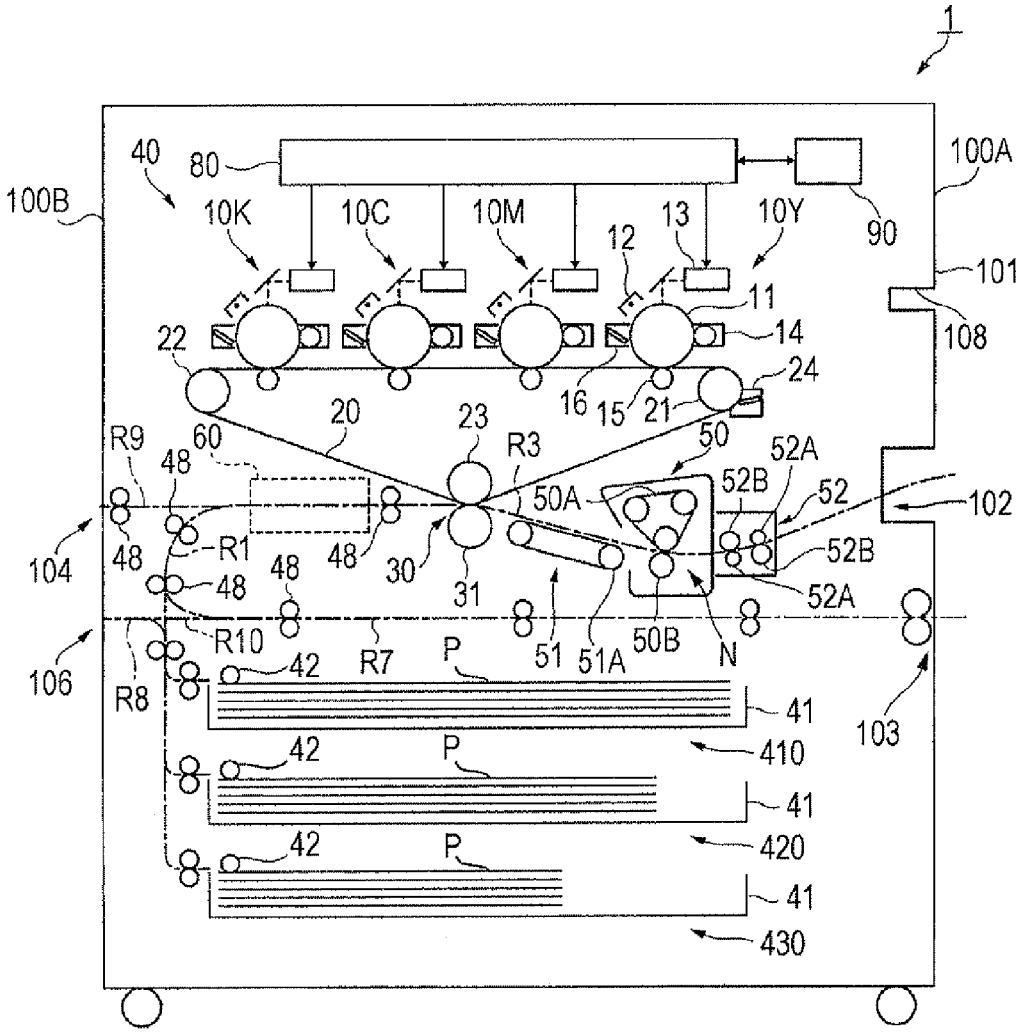
FIG. 2 illustrates the overall configuration of an image forming apparatus.

Next, the image forming apparatus 1 will be described with reference to FIG. 2. FIG. 2 illustrates the overall configuration of the image forming apparatus 1.

The image forming apparatus 1 shown in FIG. 2 has a so-called tandem-type configuration and includes multiple image forming units 10 (10Y, 10M, 10C, and 10K) that form toner images of different color components by electrophotography. The image forming apparatus 1 is provided with an integrated controller 80 (to be described later) that receives a print command or image data for image formation from, for example, a personal computer (PC, not shown) connected to the image forming apparatus 1 via a network and that controls the operation of each device and each section constituting the image forming apparatus 1. The image forming apparatus 1 is also provided with a user interface (UI) 90 that is constituted of a display panel. The UI 90 outputs a command received from a user to the integrated controller 80 and provides information from the integrated controller 80 to the user.

The image forming apparatus 1 further includes an intermediate transfer belt 20 onto which the toner images of the different dolor components formed at the respective image forming units 10 are sequentially transferred (first-transferred) and that bears the toner images, and a second-transfer device 30 that collectively transfers (second-transfers) the toner images on the intermediate transfer belt 20 onto a sheet P. The image forming units 10, the intermediate transfer belt 20, and the second-transfer device 30 may be considered as an image forming section 40.

The image forming apparatus 1 is provided with a first sheet transport path R1 used for transporting a sheet P toward the second-transfer device 30; a second sheet transport path R3 used for transporting the sheet P that has passed through the second-transfer device 30; a third sheet transport path R7 that extends from an end surface 100A, which faces the sheet processing apparatus 5, and connects to the first sheet transport path R1; and a fourth sheet transport path R9 that extends from an end surface 100B, which faces the sheet feed apparatus 3, and connects to the first sheet transport path R1. Furthermore, the image forming apparatus 1 is also provided with a fifth sheet transport path R8 that branches off from the first sheet transport path R1 and extends to the end surface 100B, and a sixth sheet transport path R10 that connects the third sheet transport path R7 and the fifth sheet transport path R8.

Moreover, the image forming apparatus 1 is provided with a position adjuster 60 (to be described in detail later) that adjusts the position of a sheet P transported toward the second-transfer device 30 along the first sheet transport path R1. The first sheet transport path R1 to the sixth sheet transport path R10 are provided with multiple transport rollers 48 that transport a sheet P.

The end surface 100A of a housing 101 is provided with openings 102 and 103, and the end surface 100B of the housing 101 is provided with openings 104 and 106.

A sheet P transported along the second sheet transport path R3 is discharged toward the sheet processing apparatus 5 via the opening 102. A sheet P transported from the sheet processing apparatus 5 enters the housing 101 via the opening 103 and is transported along the third sheet transport path R7. A sheet P transported from the sheet transport apparatus 4 enters the housing 101 via the opening (receiving section) 104 and is transported along the fourth sheet transport path R9. A sheet P transported along the first sheet transport path R1 or the third sheet transport path R7 is discharged toward the sheet transport apparatus 4 via the opening 106.

In the housing 101, the end surface 100A provided with the opening 102 has a positioning hole 108.

Furthermore, the image forming apparatus 1 is provided with a first sheet feed device 410, a second sheet feed device 420, and a third sheet feed device 430 that feed sheets P to the first sheet transport path R1.

The first sheet feed device 410 to the third sheet feed device 430 have the same configuration. Each of the first sheet feed device 410 to the third sheet feed device 430 is provided with a sheet accommodation section 41 that accommodates sheets P, and a fetching roller 42 that is provided above the sheet accommodation section 41 and at the downstream thereof in the transport direction of a sheet P (i.e., at the left side of the sheet accommodation section 41 in FIG. 2). The fetching roller 42 fetches a sheet P from the sheet accommodation section 41 and transports the sheet P. The first sheet feed device 410 to the third sheet feed device 430 may be considered as accommodation sections.

The second sheet transport path R3 is provided with a fixing device 50 that fixes an image second-transferred on a sheet P by the second-transfer device 30, which is an example of a location where an image is formed onto a sheet, onto the sheet P. The fixing device 50 is provided with a heating belt 50A that is heated by a built-in heater (not shown) and a pressing roller 50B that presses the heating belt 50A. When the sheet P passes through a nip N where the heating belt 50A and the pressing roller 50B press against each other, the sheet P is pressed and heated, whereby the image on the sheet P becomes fixed onto the sheet P.

A transport device 51 that transports the sheet P that has passed through the second-transfer device 30 toward the fixing device 50 is provided between the second-transfer device 30 and the fixing device 50. The transport device 51 has a rotatable belt 51A and transports the sheet P while supporting the sheet P on this belt 51A.

A curl correcting device 52 that corrects bending (i.e., curling) of the sheet P having the image fixed thereon by the fixing device 50 is provided in the second sheet transport path R3. The curl correcting device 52 has two pairs of rollers in the second sheet transport path R3. Each pair includes a rigid roller 52A and an elastic roller 52B that drives the sheet P while pressing against the rigid roller 52A. With regard to the positional relationship between the two pairs of rigid rollers 52A and elastic rollers 52B disposed with the second sheet transport path R3 interposed therebetween, the two rollers in one pair and the two rollers in the other pair are disposed in an inverted configuration relative to the second sheet transport path R3.

Each of the image forming units 10 includes a rotatably-attached photoconductor drum 11. Each photoconductor drum 11 is surrounded by a charging device 12 that electrostatically charges the photoconductor drum 11, an exposure device 13 that exposes the photoconductor drum 11 to light so as to write an electrostatic latent image thereon, and a developing device 14 that develops the electrostatic latent image on the photoconductor drum 11 into a visible image by using toner. Moreover, each photoconductor drum 11 is provided with a first-transfer device 15 that transfers the toner image of the corresponding color component formed on the photoconductor drum 11 onto the intermediate transfer belt 20, and a drum cleaning device 16 that removes residual toner from the photoconductor drum 11.

The intermediate transfer belt 20 is wrapped around three rollers 21 to 23 and is provided in a rotatable manner. Of these three rollers 21 to 23, the roller 22 is configured to drive the intermediate transfer belt 20. The roller 23 is disposed facing a second-transfer roller 31, which is located below the intermediate transfer belt 20, with the intermediate transfer belt 20 interposed therebetween. The second-transfer roller 31 and the roller 23 constitute the second-transfer device 30. A belt cleaning device 24 that removes residual toner from the intermediate transfer belt 20 is provided at a position where the belt cleaning device 24 faces the roller 21 with the intermediate transfer belt 20 interposed therebetween.

Sheet Feed Apparatus 3

Figure 3:
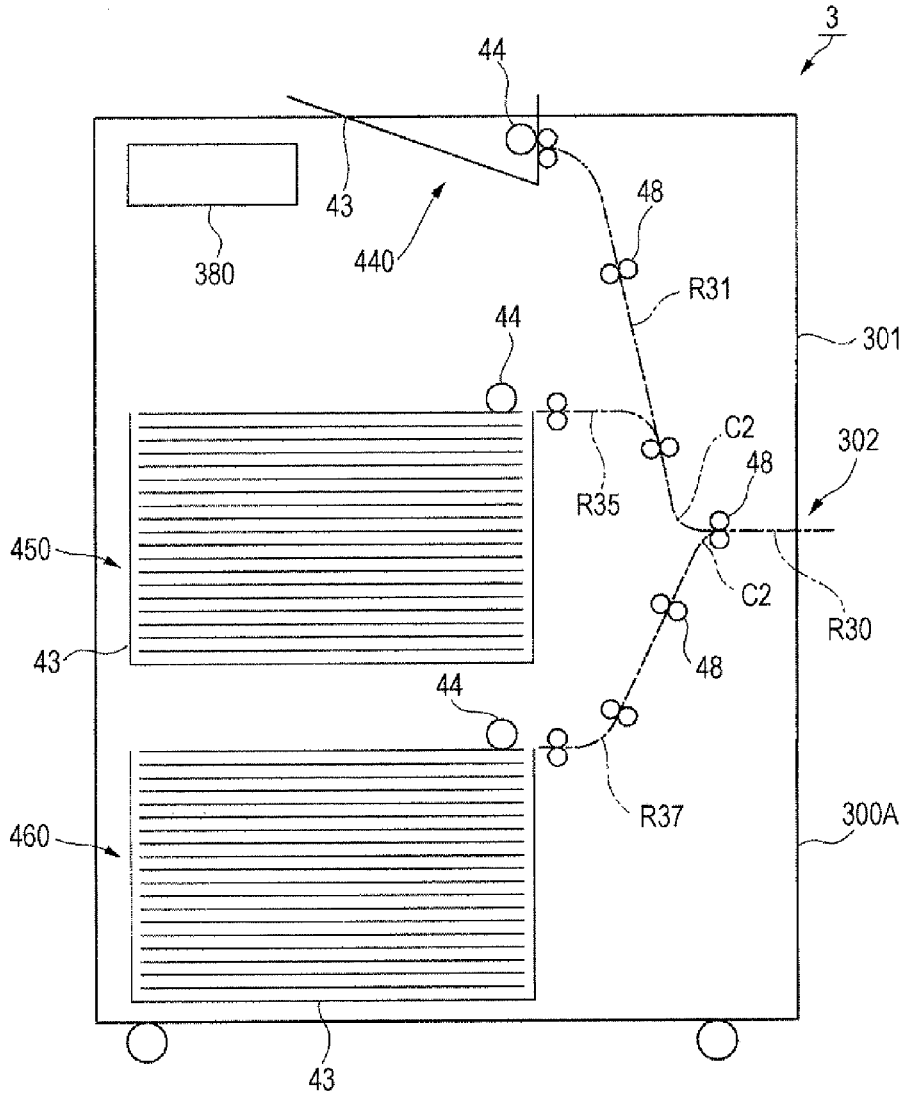
FIG. 3 illustrates the overall configuration of a sheet feed apparatus.

Next, the sheet feed apparatus 3 will be described with reference to FIG. 3. FIG. 3 illustrates the overall configuration of the sheet feed apparatus 3.

The sheet feed apparatus 3 shown in FIG. 3 is a so-called high-capacity feeder (HCF) and is capable of feeding a sheet P toward the image forming apparatus 1 at high speed. The sheet feed apparatus 3 is used as a so-called optional apparatus when performing an image forming operation on, for example, coated paper or thick paper so that the frequency of resupplying sheets P may be reduced.

The sheet feed apparatus 3 is provided with a first sheet feed path R30 used for transporting a sheet P toward the image forming apparatus 1, and a second sheet feed path R31, a third sheet feed path R35, and a fourth sheet feed path R37 that are connected to the first sheet feed path R30. The first sheet feed path R30, the second sheet feed path R31, and the third sheet feed path R35 have second curve portions C2 where a sheet P transported from any of a fourth sheet feed device 440 to a sixth sheet feed device 460 is curved toward the first sheet feed path R30.

The first sheet feed path R30 to the fourth sheet feed path R37 are provided with multiple transport rollers 48 that transport a sheet P.

Furthermore, the sheet feed apparatus 3 is provided with a feed controller 380 (to be described later) that controls the operation of each device and each section constituting the sheet feed apparatus 3.

Moreover, the sheet feed apparatus 3 includes a housing 301. An end surface 300A of this housing 301 is provided with an opening 302. A sheet P transported along the first sheet feed path R30 is discharged toward the sheet transport apparatus 4 via the opening (discharge section) 302.

The sheet feed apparatus 3 is provided with the fourth sheet feed device 440, the fifth sheet feed device 450, and the sixth sheet feed device 460 that feed sheets P to the second sheet feed path R31, the third sheet feed path R35, and the fourth sheet feed path R37, respectively. Each of the fourth sheet feed device 440 to the sixth sheet feed device 460 is provided with a sheet load section 43 on which sheets P are loaded, and a fetching roller 44 that is provided above the sheet load section 43 and at the downstream thereof in the transport direction of a sheet P (i.e., at the right side of the sheet load section 43 in FIG. 3). The fetching roller 44 fetches a sheet P from the sheet load section 43 and transports the sheet P.

In the example shown in FIG. 3, the sheet load section 43 of the fourth sheet feed device 440 has an inclined section on which a sheet P is loaded. The sheet load sections 43 of the fifth sheet feed device 450 and the sixth sheet feed device 460 each have a housing that accommodates sheets P therein. Alternatively, the sheet load sections 43 may have different configurations.

The first sheet feed path R30 in the sheet feed apparatus 3 is provided at a position where it is connectable to a sixth sheet feed path R41 (to be described later) in the sheet transport apparatus 4. The sheet feed apparatus 3 may be connected directly to the image forming apparatus 1 without the intervention of the sheet transport apparatus 4, as described above. In this case, the first sheet feed path R30 in the sheet feed apparatus 3 is connected to the fourth sheet transport path R9 in the image forming apparatus 1.

Specifically, the first sheet feed path R30 in the sheet feed apparatus 3 is provided at a position where it is connectable to either of the sixth sheet feed path R41 in the sheet transport apparatus 4 and the fourth sheet transport path R9 in the image forming apparatus 1. More specifically, by providing the opening 302 of the sheet feed apparatus 3 and the opening 104 of the image forming apparatus 1 at corresponding height positions, the image forming system 100 may be formed by connecting the sheet feed apparatus 3 directly to the image forming apparatus 1 without the intervention of the sheet transport apparatus 4.

Sheet Transport Apparatus 4

Figure 4:
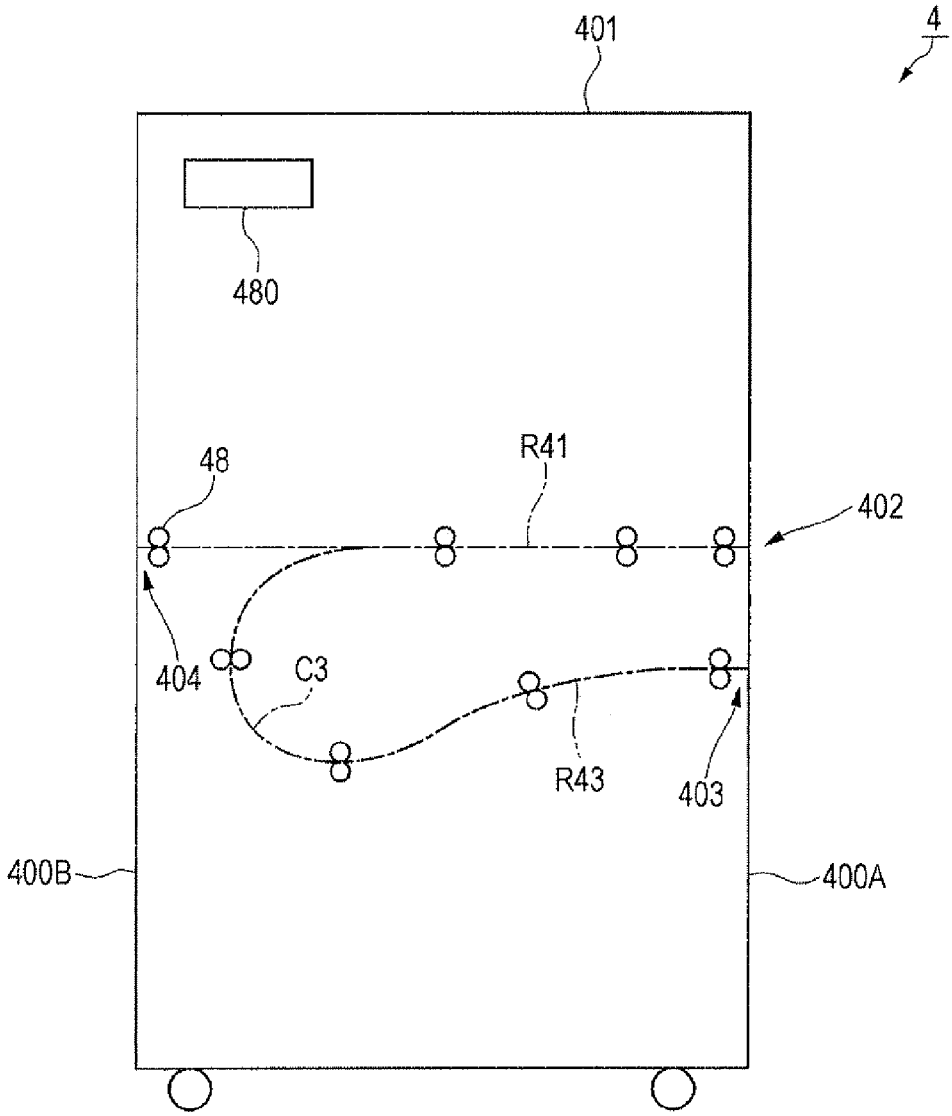
FIG. 4 illustrates the overall configuration of a sheet transport apparatus.

The sheet transport apparatus 4 will now be described with reference to FIG. 4. FIG. 4 illustrates the overall configuration of the sheet transport apparatus 4.

The sheet transport apparatus 4 shown in FIG. 4 is capable of transporting a sheet P fed from the sheet feed apparatus 3 to the image forming apparatus 1 and is also capable of receiving a sheet P fed from the image forming apparatus 1 and then transporting the sheet P again to the image forming apparatus 1.

The sheet transport apparatus 4 is provided with the sixth sheet feed path R41 used for transporting a sheet P fed from the sheet feed apparatus 3 toward the image forming apparatus 1, and a seventh sheet feed path R43 that is used for transporting a sheet P fed from the image forming apparatus 1 and that is connected to the sixth sheet feed path R41. The seventh sheet feed path R43 has a third curve portion C3 where the sheet P transported from the image forming apparatus 1 is curved toward the sixth sheet feed path R41.

Furthermore, the sixth sheet feed path R41 and the seventh sheet feed path R43 are provided with multiple transport rollers 48 that transport a sheet P.

The sheet transport apparatus 4 is also provided with a transport controller 480 (to be described later) that controls the operation of each device and each section constituting the sheet transport apparatus 4.

Moreover, the sheet transport apparatus 4 includes a housing 401. An end surface 400A at the image forming apparatus 1 side of the housing 401 is provided with openings 402 and 403. An end surface 400B at the sheet feed apparatus 3 side of the housing 401 is provided with an opening (receiving section or first receiving section) 404.

A sheet P transported from the sheet feed apparatus 3 is received via the opening 404 and is transported along the sixth sheet feed path (relay transport path or first transport path) R41. Subsequently, the sheet P is discharged toward the image forming apparatus 1 via the opening (discharge section) 402. The sixth sheet feed path R41 has a substantially linear shape extending in one direction (i.e., substantially horizontal direction in the example shown in FIG. 6) from the opening 404 toward the opening 402.

A sheet P transported from the image forming apparatus 1 is received via the opening (receiving section or second receiving section) 403 and is transported along the seventh sheet feed path (second transport path) R43. Subsequently, the sheet P is discharged toward the image forming apparatus 1 via the sixth sheet feed path R41 and the opening 402.

Sheet Processing Apparatus 5

Figure 5:
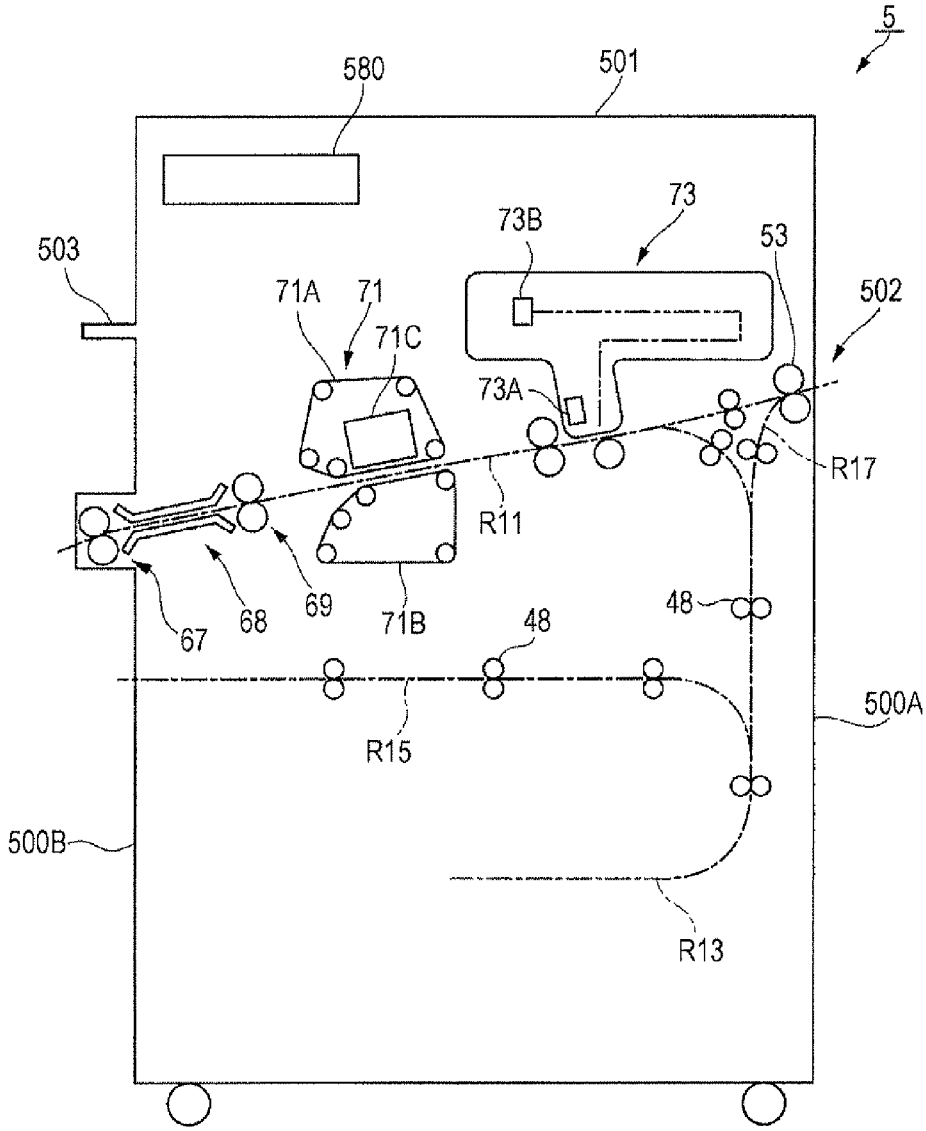
FIG. 5 illustrates the overall configuration of a sheet processing apparatus.

The sheet processing apparatus 5 will now be described with reference to FIG. 5. FIG. 5 illustrates the overall configuration of the sheet processing apparatus 5.

The sheet processing apparatus 5 is provided with a receiving roller 67 that receives a sheet P having an image fixed thereon by the fixing device 50 of the image forming apparatus 1, a movable transport roller 69 that further transports the sheet P received by the receiving roller 67, and a guide member (i.e., a so-called chute) 68 that is provided between the receiving roller 67 and the movable transport roller 69. The guide member 68 forms a part of an eighth sheet transport path R11 and guides the sheet P that has passed through the receiving roller 67 toward the movable transport roller 69.

The sheet processing apparatus 5 includes a cooling device 71 that cools the aforementioned toner images of the respective colors and facilitates the fixation of the toner images onto the sheet P, an in-line sensor 73 that optically detects, for example, density defects, image defects, and image-position defects in the toner images fixed on the sheet P, a discharge roller 53 that discharges the sheet P that has passed through the in-line sensor 73 outward from the sheet processing apparatus 5, and a processing controller 580 (to be described later) that controls the operation of each device and each section constituting the sheet processing apparatus 5.

The sheet processing apparatus 5 is provided with the eighth sheet transport path R11 used for transporting the sheet P discharged from the image forming apparatus 1, an inversion transport path R13 that branches off from the eighth sheet transport path R11 at the downstream side of the in-line sensor 73, a second re-transport path R15 that branches off from the inversion transport path R13 and connects to the third sheet transport path R7 in the image forming apparatus 1, and a ninth sheet transport path R17 that branches off from the inversion transport path R13 and connects to the eighth sheet transport path R11.

The eighth sheet transport path R11, the inversion transport path R13, the second re-transport path R15, and the ninth sheet transport path R17 are provided with multiple transport rollers 48 that transport a sheet P.

The sheet processing apparatus 5 includes a housing 501. An end surface 500A of the housing 501 located opposite the image forming apparatus 1 is provided with an opening 502. A sheet P transported along the eighth sheet transport path R11 is discharged outside the housing 501 by the discharge roller 53 via the opening 502.

An end surface 500B of the housing 501 that faces the image forming apparatus 1 is provided with a positioning pin 503 at a position corresponding to the positioning hole 108 in the image forming apparatus 1. The positioning pin 503 protrudes outward from the housing 501. When connecting the sheet processing apparatus 5 to the image forming apparatus 1, the positioning pin 503 is inserted into the positioning hole 108 so that the sheet processing apparatus 5 is positionally set relative to the image forming apparatus 1.

Although not shown, in an area where the image, forming apparatus 1 and the sheet transport apparatus 4 face each other, the image forming apparatus 1 has a positioning hole and the sheet transport apparatus 4 has a positioning pin. Moreover, in an area where the sheet transport apparatus 4 and the sheet feed apparatus 3 face each other, the sheet transport apparatus 4 has a positioning hole and the sheet feed apparatus 3 has a positioning pin.

Consequently, when the image forming apparatus 1 is used alone, positioning pins do not protrude from the side surfaces 100A and 100B of the image forming apparatus 1. Furthermore, when connecting the sheet feed apparatus 3 directly to the image forming apparatus 1, the positioning pin of the sheet feed apparatus 3 is inserted into the corresponding positioning hole in the image forming apparatus 1 so that the sheet feed apparatus 3 is positionally set relative to the image forming apparatus 1.

The cooling device 71 includes transport belts 71A and 71B that transport the sheet P along the eighth sheet transport path R11 while nipping the sheet P from upper and lower sides thereof, a heat sink 71C that is formed of multiple fins and cools the transport belts 71A and 71B by receiving air sent from an externally-provided fan (not shown), and multiple tension rollers that rotate the transport belts 71A and 71B while applying tension thereto.

The heat sink 71C is in contact with the inner peripheral surface of the transport belt 71A so as to absorb heat from the transport belt 71A. Thus, the sheet P heated by the fixing device 50 is cooled, whereby the toner on the surface of the sheet P becomes fixed thereon while maintaining its smoothness.

The in-line sensor 73 includes a light source 73A formed of, for example, an incandescent lamp or a white-light emitting diode, and a light receiving element 73B formed of, for example, a charge coupled device (CCD).

The light receiving element 73B receives light radiated from the light source 73A and reflected by the sheet P traveling along the eighth sheet transport path R11. Based on the intensity of the received light, the light receiving element 73B outputs a signal to the integrated controller 80 of the image forming apparatus 1. Based on the signal from the in-line sensor 73, the integrated controller 80 corrects images to be formed at the image forming units 10. For example, the intensity of light radiated by the exposure devices 13 or an image formation position is corrected on the basis of the signal from the in-line sensor 73.

In the sheet processing apparatus 5 according to this exemplary embodiment, a sheet P having an image formed on one face thereof may be switched back by the inversion transport path R13, where appropriate. Then, the switched-back sheet P whose leading edge and trailing edge in the transport direction thereof have been switched is transported toward the ninth sheet transport path R17 or the second re-transport path R15.

In a case where the sheet P is transported from the inversion transport path R13 toward the ninth sheet transport path R17, the sheet P, in an inverted state, is transported along the ninth sheet transport path R17 or the eighth sheet transport path R11 so as to be discharged outside the sheet processing apparatus 5.

On the other hand, in a case where the sheet P is transported from the inversion transport path R13 toward the second re-transport path R15, the sheet P, in an inverted state, is transported again to the second-transfer device 30 via the third sheet transport path R7 or the first sheet transport path R1. Thus, an image is formed on the other face of the inverted sheet P at the second-transfer device 30. In other words, images are formed on both faces of the sheet P. The inversion transport path R13 may be considered as a switch-back path or a duplex printing path.

Operation of Image Forming System 100

Next, an image forming operation performed by the image forming system 100 according to this exemplary embodiment will be described with reference to FIGS. 1 to 5.

First, in the image forming system 100, one end of the sixth sheet feed path R41 in the sheet transport apparatus 4 is connected to the first sheet feed path R30 in the sheet feed apparatus 3, and the other end is connected to the fourth sheet transport path R9 in the image forming apparatus 1. The seventh sheet feed path R43 in the sheet transport apparatus 4 is connected to the fifth sheet transport path R8 in the image forming apparatus 1. Furthermore, the second sheet transport path R3 in the image forming apparatus 1 is connected to the eighth sheet transport path R11 in the sheet processing apparatus 5. Moreover, the third sheet transport path R7 in the image forming apparatus 1 is connected to the second re-transport path R15 in the sheet processing apparatus 5.

The first sheet feed path R30 in the sheet feed apparatus 3, the sixth sheet feed path R41 in the sheet transport apparatus 4, the fourth sheet transport path R9 in the image forming apparatus 1, and the downstream side of a curve portion C1 (to be described later) of the first sheet transport path R1 in the sheet transport direction extend substantially linearly in one direction (i.e., substantially in the horizontal direction in the example shown in the drawings).

Transport mechanisms, such as the transport rollers 48, disposed in the paths for transporting a sheet P are capable of reliably transporting the sheet P without causing the sheet P to fall off even if the sheet P is short in the transport direction thereof, such as a minimum-size sheet P used in the image forming system 100. The transport mechanisms are disposed such that the distances between the transport mechanisms are shorter than the length of the minimum-size sheet P in the transport direction. More specifically, the transport mechanisms are disposed such that the distances between the transport mechanisms that transport a sheet P between the image forming apparatus 1, the sheet feed apparatus 3, the sheet transport apparatus 4, and the sheet processing apparatus 5 are shorter than the length of the minimum-size sheet P in the transport direction.

When image data created by the PC (not shown) is received by the integrated controller 80 of the image forming apparatus 1, the integrated controller 80 performs image processing on the image data. The image-processed image data is output to the exposure devices 13. Each exposure device 13 receiving the image data selectively exposes the corresponding photoconductor drum 11 electrostatically charged by the corresponding charging device 12 to light, thereby forming an electrostatic latent image on the photoconductor drum 11. The electrostatic latent image formed on the photoconductor drum 11 is developed into, for example, a black (K) toner image by the corresponding developing device 14.

In accordance with an image formation timing, a sheet P is fed to the first sheet transport path R1 from any one of the first sheet feed device 410 to the sixth sheet feed device 460. This sheet P is transported toward the second-transfer device 30 in accordance with a rotation timing of the intermediate transfer belt 20. At the second-transfer device 30, the toner image formed on the photoconductor drum 11 is transferred onto the sheet P.

Subsequently, the sheet P having the toner image transferred thereon is transported along the second sheet transport path R3 and undergoes a fixing process at the fixing device 50. Then, the sheet P having the fixed image thereon undergoes a curl correction process at the curl correcting device 52. Subsequently, the sheet P that has passed through the curl correcting device 52 is discharged from the opening 102 provided in the housing 101.

The sheet P discharged from the opening 102 in the image forming apparatus 1 is cooled by the cooling device 71 while being transported along the eighth sheet transport path R11 in the sheet processing apparatus 5, and the in-line sensor 73 detects the toner image. Then, the sheet P is transported along the eighth sheet transport path R11 and is discharged from the opening 502 in the housing 501 so as to be loaded onto a sheet load section (not shown).

After each image forming unit 10 performs the image forming process and the toner image on the photoconductor drum 11 is transferred onto the sheet P, residual toner is sometimes adhered on the photoconductor drum 11. The residual toner on the photoconductor drum 11 is removed therefrom by the drum cleaning device 16. Likewise, residual toner on the intermediate transfer belt 20 is removed therefrom by the belt cleaning device 24.

When duplex printing is to be performed, the sheet P that has the fixed image formed on one face of the sheet P as the result of the above-described process and that has passed through the in-line sensor 73 is guided toward the inversion transport path R13 from the eighth sheet transport path R11. Then, the sheet P switched back by the inversion transport path R13 is transported again to the second-transfer device 30 via the second re-transport path R15, the third sheet transport path R7, and the first sheet transport path R1. Alternatively, the sheet P switched back by the inversion transport path R13 is transported again to the second-transfer device 30 via the second re-transport path R15, the third sheet transport path R7, the sixth sheet transport path R10, the fifth sheet transport path R8, the sixth sheet feed path R41, the seventh sheet feed path R43, the fourth sheet transport path R9, and the first sheet transport path R1.

The sheet P having a toner image formed on the other face thereof passes through the second-transfer device 30 and the curl correcting device 52 again. Then, the sheet P is discharged from the opening 102. The sheet P discharged from the opening 102 in the image forming apparatus 1 is transported along the eighth sheet transport path R11 in the sheet processing apparatus 5 and travels through the cooling device 71, the in-line sensor 73, and the opening 502 so as to be loaded onto the sheet load section (not shown).

Because the sheet P is cooled by the cooling device 71, as described above, the toner on the sheet P loaded on the sheet load section may be prevented from being stacked onto the toner on another sheet P without being cooled to a predetermined temperature or lower, thereby suppressing adhesion between the sheets P. For example, when the sheet P used is coated paper or thick paper, the process for cooling the sheet P takes a longer time than when the sheet P used is normal paper. However, by providing the cooling device 71, as described above, the sheet P may be cooled within a short period of time.

In this exemplary embodiment, the sheet P transported along the second sheet transport path R3 and the eighth sheet transport path R11 travels through the fixing device 50, the curl correcting device 52, and the cooling device 71 in that order.

The toner used for forming an image on the sheet P has thermoplastic properties. In this exemplary embodiment, the toner is made to travel through the curl correcting device 52 immediately after the toner (i.e., fixed image) is heated by the fixing device 50 so that the curl correction process is performed on the sheet P in a state where the toner is high in temperature and the sheet P is readily deformable. Accordingly, a curl may be reliably removed from the sheet P, as compared with a case where the cooling device 71 is disposed upstream of the curl correcting device 52 in the transport direction of the sheet P such that the curl correction process is performed after the sheet P is cooled by the cooling device 71, in contrast to this exemplary embodiment. In other words, the curl correction process may be performed more effectively in this exemplary embodiment.

Furthermore, in this exemplary embodiment, the curl-corrected sheet P is cooled while being nipped between the transport belts 71A and 71B of the cooling device 71. Thus, the sheet P may be prevented from curling again as the sheet P that has already been curl-corrected by the curl correcting device 52 is cooled.

The transport mechanisms, such as the transport rollers 48 or so-called V-tra (not shown), which transport the sheet P curl-corrected by the curl correcting device 52 to the cooling device 71 come into surface contact with the entire sheet P, thereby suppressing the occurrence of, for example, so-called roller streaks or scratches on the image or images formed on the sheet P, which may be caused by the transport rollers 48 coming into contact therewith.

Position Adjuster 60

Figure 6A:
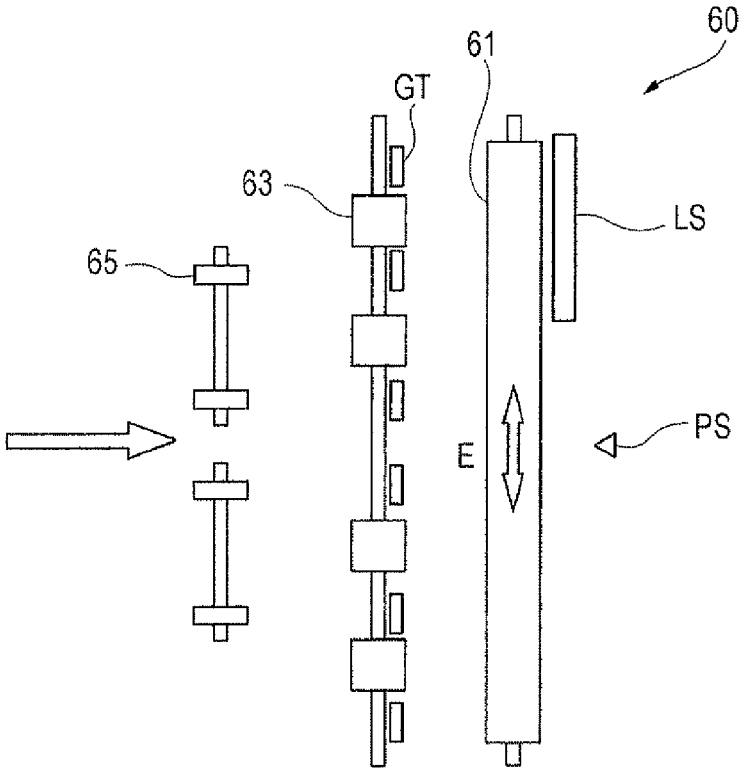
FIGS. 6A and 6*b* illustrate the configuration of a position adjuster.
Figure 6B:
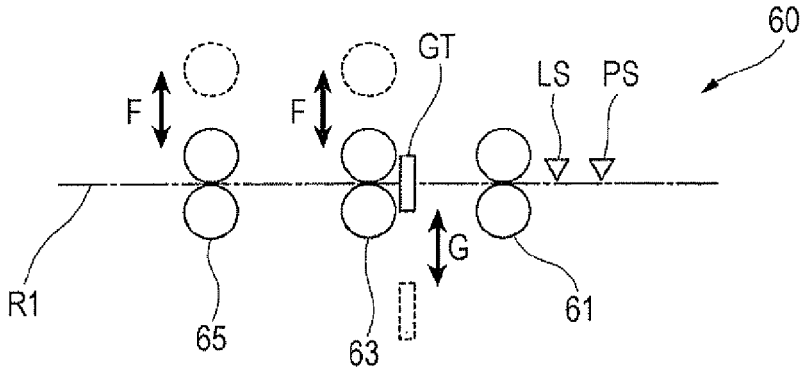

Next, the configuration of the position adjuster 60 provided in the image forming apparatus 1 will be described with reference to FIGS. 6A and 6B. FIGS. 6A and 6B illustrate the configuration of the position adjuster 60. More specifically, FIG. 6A is a top view of the position adjuster 60, and FIG. 6B is a side view of the position adjuster 60.

As shown in FIG. 6A, the position adjuster 60 includes a registration roller 61 that transports a sheet P to the second-transfer device 30 in accordance with a moving timing of the intermediate transfer belt 20 having a toner image formed thereon, a pre-registration roller 63 that is located upstream of the registration roller 61 in the first sheet transport path R1 and that transports the sheet P toward the registration roller 61, and a gate roller 65 that is located upstream of the pre-registration roller 63 in the first sheet transport path R1 and that transports the sheet P toward a gate GT (to be described later). Each of these rollers is formed of a pair of roller-shaped members, and the roller-shaped members rotate while nipping the sheet P therebetween so as to transport the sheet P.

The position adjuster 60 also includes the gate GT located between the registration roller 61 and the pre-registration roller 63 in the first sheet transport path R1. The gate GT is a plate-shaped member onto which the leading edge of the sheet P abuts. In this exemplary embodiment, the leading edge of the sheet P abuts on the gate GT so that skewing of the sheet P is corrected.

Furthermore, the position adjuster 60 includes a line sensor LS that is located downstream of the registration roller 61 in the first sheet transport path R1 and that detects an edge of the sheet P in a direction intersecting the transport direction thereof, and a passing sensor PS that is located downstream of the registration roller 61 in the first sheet transport path R1 and that detects the downstream edge (i.e., leading edge) of the sheet P in the transport direction thereof.

The registration roller 61 includes a known moving mechanism (not shown) constituted of, for example, a motor, a rack, and a pinion. By actuating the moving mechanism, the registration roller 61 is movable in the direction intersecting the transport direction of the sheet P (see arrow E in FIG. 6A).

The pre-registration roller 63 and the gate roller 65 each include a known separating mechanism (not shown) constituted of, for example, a motor and a cam. By actuating the separating mechanism included in each of the pre-registration roller 63 and the gate roller 65, one of the roller-shaped members of the pair of roller-shaped members is movable away from the other roller-shaped member (see arrow F in FIG. 6B).

The gate GT includes a known retracting mechanism (not shown) constituted of, for example, a motor and a crank. By actuating the retracting mechanism, the gate GT is retractable from the first sheet transport path R1 (see arrow G in FIG. 6B).

Figures 7A, 7B, 7C:
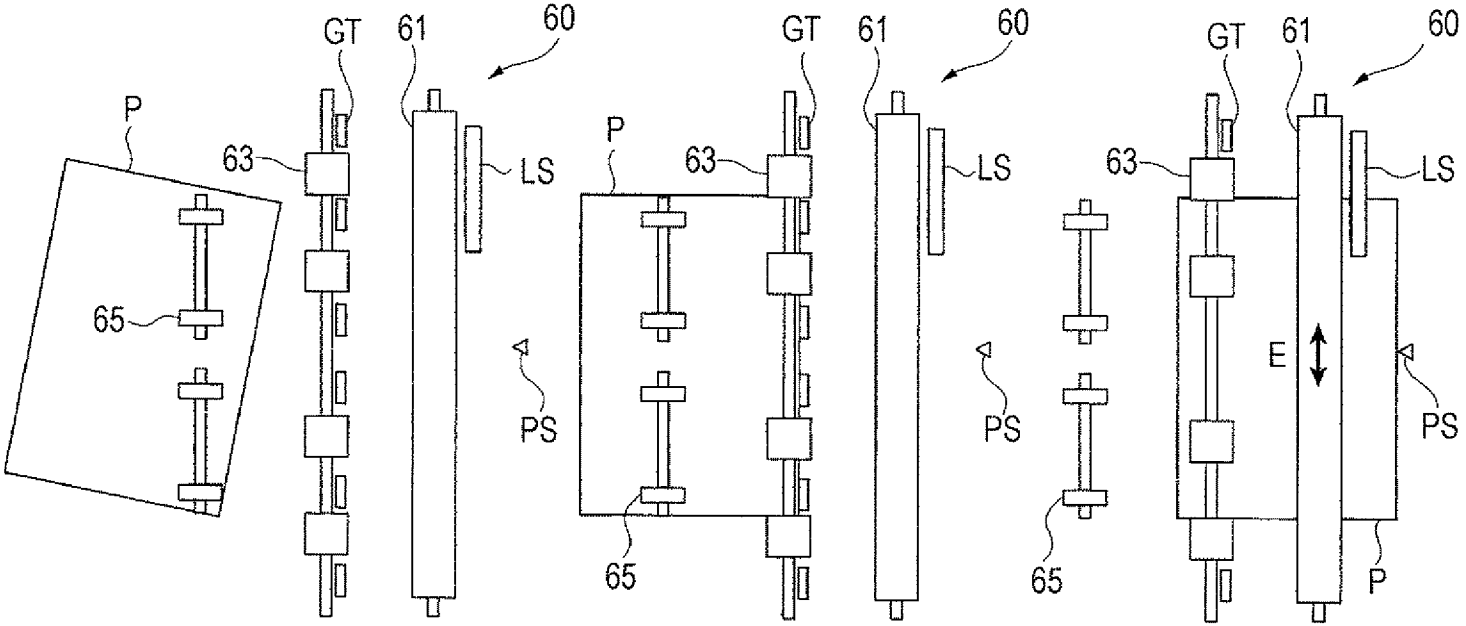
FIGS. 7A to 7C illustrate a position adjusting operation of the position adjuster.

Next, a position adjusting operation performed by the position adjuster 60 will be described with reference to FIGS. 7A to 7C. FIGS. 7A to 7C illustrate the position adjusting operation of the position adjuster 60.

First, when a sheet P is transported to the position adjuster 60, the gate GT is disposed in the first sheet transport path R1 at a position onto which the sheet P abuts. With regard to the pre-registration roller 63, one of the roller-shaped members thereof is positioned away from the other roller-shaped member. With regard to the gate roller 65, the two roller-shaped members thereof are in contact with each other.

Subsequently, as shown in FIG. 7A, the sheet P transported from upstream is received by the gate roller 65 and is transported further toward the gate GT.

Then, as shown in FIG. 7B, the leading edge of the sheet P transported by the gate roller 65 abuts onto the gate GT so that the sheet P becomes looped (i.e., bent), whereby skewing of the sheet P is corrected.

Subsequently, one of the roller-shaped members of the gate roller 65 is moved away from the other roller-shaped member, and the two roller-shaped members of the pre-registration roller 63 are brought into contact with each other. Furthermore, the gate GT is retracted from the first sheet transport path R1. By rotating the pre-registration roller 63 in this state, the skew-corrected sheet P is transported toward the registration roller 61.

When the registration roller 61 receives the sheet P, one of the roller-shaped members of the pre-registration roller 63 is moved away from the other roller-shaped member. Then, the registration roller 61 adjusts the position of the sheet P while moving in the direction intersecting the transport direction of the sheet P (see arrow E in FIG. 7C) in accordance with the leading-edge position of the sheet P detected by the line sensor LS, and temporarily stops transporting the sheet P in accordance with a timing at which the passing sensor PS detects the leading edge of the sheet P.

Then, the registration roller 61 rotates in accordance with the moving timing of the intermediate transfer belt 20 having a toner image formed thereon, thereby transporting the sheet P toward the second-transfer device 30.

The position adjuster 60 operates in the above-described manner so that the position of the sheet P to be transported toward the second-transfer device 30 is adjusted, whereby the sheet P may be positionally aligned with the image to be transferred thereto at the second-transfer device 30. Furthermore, when images are to be formed on both faces of the sheet P, the images to be formed on the front face and the back face of the sheet P may be positionally aligned with each other.

By providing the gate GT, as described above, the occurrence of a paper jam due to buckling of the sheet P caused when the sheet P is brought into abutment with a so-called side guide in a configuration different from the example shown in the drawings may be suppressed.

Configuration of Position Adjuster 60 and Surrounding Area Thereof

Figure 8:
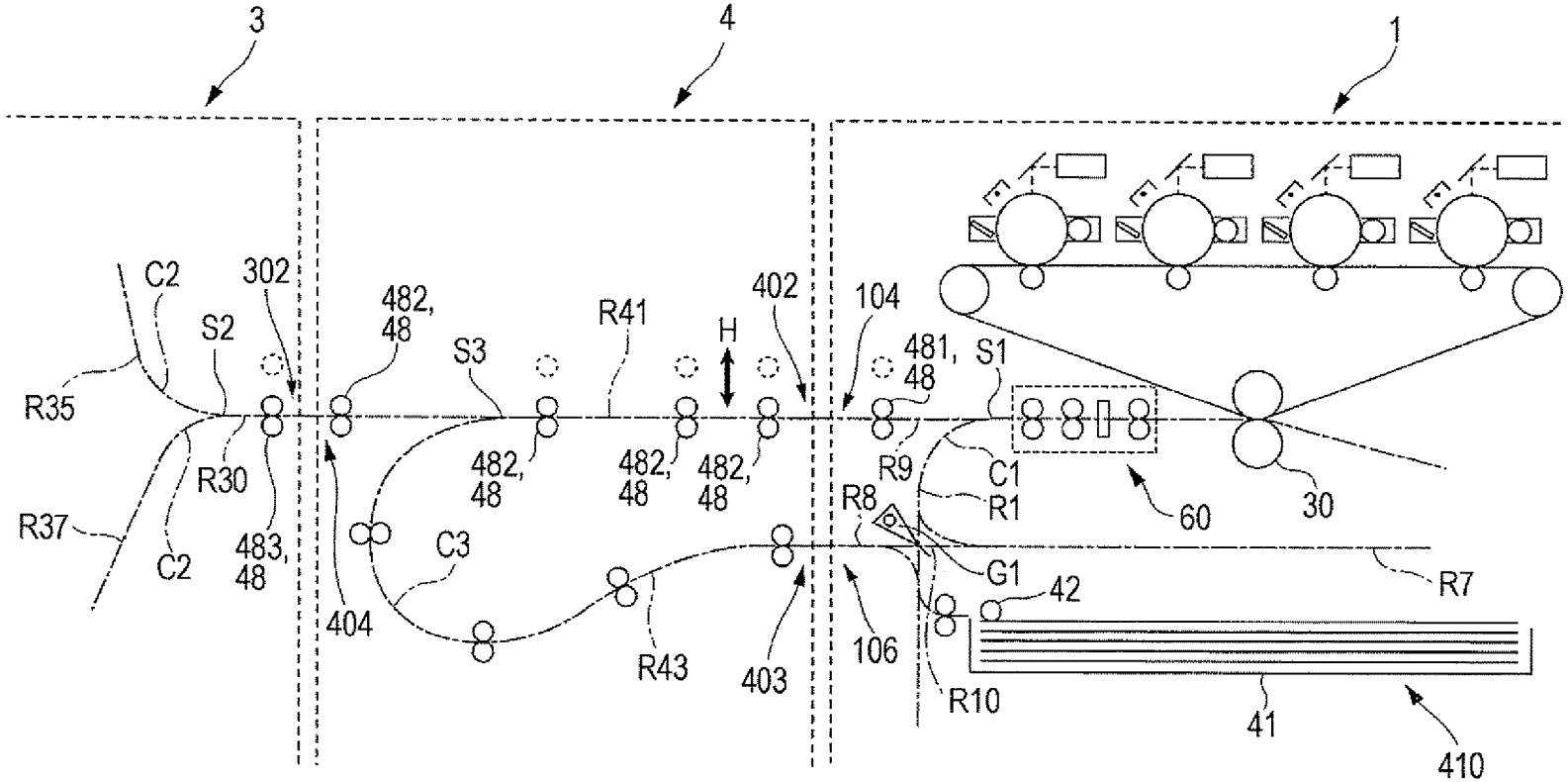
FIG. 8 illustrates the configuration of the position adjuster and a surrounding area thereof.

Next, the configuration of the position adjuster 60 and a surrounding area thereof will be described with reference to FIG. 8. FIG. 8 illustrates the configuration of the position adjuster 60 and the surrounding area thereof.

As shown in FIG. 8, the position adjuster 60 is provided in a segment of the first sheet transport path R1 that extends toward the second-transfer device 30 from a first connection point S1 between the first sheet transport path R1 and the fourth sheet transport path R9. More specifically, the position adjuster 60 is provided along a straight line (extending substantially in the horizontal direction in the example shown in FIG. 8) that connects the second-transfer device 30 to the curve portion C1 where the first sheet transport path R1, used for transporting a sheet P from any one of the first sheet feed device 410 to the third sheet feed device 430 of the image forming apparatus 1, curves toward the second-transfer device 30.

The first sheet transport path R1 and the fourth sheet transport path R9 may be considered as an image-formation transport path.

Alternatively, instead of being provided along a straight line, the position adjuster 60 may be gently curved and may have a radius of curvature larger than that of the first curve portion C1. Although the first curve portion C1 is provided at a position distant from the fetching roller 42 in the example shown in FIG. 8, the first sheet transport path R1 may be formed along the outer periphery of the fetching roller 42, and this segment extending along the outer periphery of the fetching roller 42 may serve as the first curve portion C1.

Generally, resistance occurring between a sheet P and a path used for transporting the sheet P is larger in the case where the path is curved than in the case where the path is not curved. In a case where there is large resistance between the sheet P and the path used for transporting the sheet P, when the position adjuster 60 adjusts the position of the sheet P, as described above, it is difficult to move the sheet P to a predetermined position, possibly resulting in reduced accuracy of the positional adjustment.

In this exemplary embodiment, the position adjuster 60 adjusts the position of the sheet P in the segment of the first sheet transport path R1 that extends from the first connection point S1 to the second-transfer device 30. This may suppress reduction in the accuracy of the positional adjustment.

Furthermore, in the example shown in FIG. 8, the substantially straight line that connects the first curve portion C1 and the second-transfer device 30 extends substantially in the horizontal direction. With the substantially straight line extending substantially in the horizontal direction, transport resistance of the sheet P when the position adjuster 60 adjusts the position of the sheet P may be suppressed. The configuration shown in FIG. 8 is merely an example and does not exclude an inclined configuration.

Although the position adjuster 60 in the first sheet transport path R1 is provided along the substantially straight line that connects the first curve portion C1 and the second-transfer device 30, if the sheet P is long in the transport direction thereof, such as when a maximum-size sheet P, for example, is used in the image forming system 100, there is sometimes a case where the trailing edge of the sheet P remains within one of the first sheet feed device 410 to the third sheet feed device 430 even while the leading edge of the sheet P has reached the position adjuster 60.

In this case, if the registration roller 61 of the position adjuster 60 adjusts the position of the sheet P, the sheet P may become skewed relative to the transport direction thereof or the sheet P may become damaged. In addition, if the position adjuster 60 performs the adjustment in a state where the trailing edge of the sheet P is located at the first curve portion C1, the transport resistance may increase if the sheet P used is, for example, thick paper having high flexural rigidity. This makes it difficult to move the trailing edge of the sheet P to a predetermined position, possibly resulting in skewing of the sheet P relative to the transport direction thereof.

In this exemplary embodiment, the substantially linear segment along which the sheet P is transported to the second-transfer device 30 or the position adjuster 60 is made as long as possible. Thus, even when the sheet P used is long in the transport direction thereof or the sheet P used is thick paper, reduction in the accuracy of the positional adjustment by the position adjuster 60 may be suppressed.

More specifically, as described above, the first sheet feed path R30 in the sheet feed apparatus 3, the sixth sheet feed path R41 in the sheet transport apparatus 4, the fourth sheet transport path R9 in the image forming apparatus 1, and the downstream side of the curve portion C1 of the first sheet transport path R1 extend substantially linearly.

Thus, a sheet P fed from the sheet feed apparatus 3 travels along a substantially linear path until reaching the position adjuster 60.

Furthermore, in this exemplary embodiment, a sheet P fed from any one of the first sheet feed device 410 to the third sheet feed device 430 of the image forming apparatus 1 is transportable via the seventh sheet feed path R43. Thus, the sheet P fed from any one of the first sheet feed device 410 to the third sheet feed device 430 travels along a segment of the sixth sheet feed path R41 that is located downstream of a third connection point S3 between the sixth sheet feed path R41 and the seventh sheet feed path R43, as well as along the fourth sheet transport path R9 in the image forming apparatus 1 and the downstream side of the curve portion C1 of the first sheet transport path R1. As a result, the sheet P travels along a substantially linear path until reaching the position adjuster 60.

According to the above configuration, the substantially linear path extending to the position adjuster 60 may be increased in length. More specifically, the distance to the mechanism that makes the sheet P move in the direction intersecting the sheet transport direction in the position adjuster 60 (i.e., the gate GT and the gate roller 65 in the example shown in the drawings) may be increased (i.e., a sufficient distance may be ensured).

As a result, a sheet P that is transported from any one of the fourth sheet feed device 440 to the sixth sheet feed device 460 and that is bent as a result of traveling through the corresponding second curve portion C2 reaches the position adjuster 60 while the sheet P maintains its substantially linear orientation. Furthermore, a sheet transported from any one of the first sheet feed device 410 to the third sheet feed device 430 via the third curve portion C3 reaches the position adjuster 60 while the sheet P maintains its substantially linear orientation.

Accordingly, the transport resistance of the sheet P may be prevented from increasing as a result of the position adjuster 60 performing the positional adjustment in a state where the trailing edge of the sheet P in the transport direction is located at the first curve portion C1, thereby suppressing reduction in the accuracy of the positional adjustment (which may occur when skewing of the sheet P is not removed by the position adjuster 60 or when the sheet P is positionally deviated in the direction intersecting the transport direction). In other words, reduction in the accuracy of the positional adjustment by the position adjuster 60 may be suppressed.

More specifically, with the above-described configuration, the distance from each second curve portion C2 to the second-transfer device 30 or from the third curve portion C3 to the second-transfer device 30 is longer than the distance of the transport path from the first curve portion C1 to the second-transfer device 30. Thus, for example, even when the sheet P bends (i.e., curls) by traveling through the first curve portion C1, a time period in which the sheet P is maintained in a substantially linear orientation is extended so that the orientation of the sheet P is made stable, thereby suppressing reduction in the quality of an image to be transferred at the second-transfer device 30. Moreover, the longer distance to the second-transfer device 30 may be considered that the transport performance of the sheet P is enhanced.

The position of the third curve portion C3 is set such that the distance from the third curve portion C3 to the second-transfer device 30 and the distance from the third curve portion C3 to the position adjuster 60 are greater than the length of a sheet P with the maximum length in the transport direction among sheets P onto which images are to be formed in the image forming system 100.

Although not described above, at least some of the transport rollers 48 located upstream of the position adjuster 60 in the transport direction (i.e., a first transport roller 481 in the image forming apparatus 1, second transport rollers 482 in the sheet transport apparatus 4, and a third transport roller 483 in the sheet feed apparatus 3 in the example shown in FIG. 8) each include a known separating mechanism (not shown) constituted of, for example, a motor and a cam. With the separating mechanism of each roller, one of roller-shaped members of each pair of roller-shaped members is movable away from the other roller-shaped member (see arrow H in FIG. 8).

The roller-shaped members of the first transport roller 481 to the third transport roller 483 are separated from each other in correspondence with a timing corresponding to the gate roller 65. Moreover, as described above, when the registration roller 61 in the position adjuster 60 is to be moved in the direction intersecting the transport direction of the sheet P (see arrow E in FIG. 7C), the roller-shaped members of the first transport roller 481 to the third transport roller 483 are separated from each other. Consequently, as the registration roller 61 moves in the direction intersecting the transport direction of the sheet P (see arrow E in FIG. 7C), skewing of the sheet P relative to the transport direction thereof may be suppressed. In other words, when the position adjuster 60 adjusts the position of the sheet P, the first transport roller 481 to the third transport roller 483 nip the sheet P, so that the positional adjustment of the sheet P may be prevented from being hindered.

In a case where images are to be formed on both faces of the sheet P by the image forming system 100 so as to produce a commercial product, it is desirable that print misalignment, which is one of the print qualities of producer goods, between front and back faces of the sheet P be reduced as much as possible. Furthermore, in a so-called color apparatus, since a sheet path is generally longer than an image path, it is difficult to shift an image relative to the sheet P. Therefore, the sheet P is positionally adjusted to the image. In the example shown in the drawings, the position adjuster 60 adjusts the position of the sheet P every time a transfer process is performed by the second-transfer device 30.

Switching Mechanism

Next, a switching mechanism that switches a transport path for a sheet P in the image forming apparatus 1 will be described with reference to FIG. 8 and FIGS. 9A to 9D. FIGS. 9A to 9D are diagrams explaining the sheet-transport-path switching mechanism.

Although not described above, the image forming apparatus 1 includes a first switch gate (switching unit) G1 that switches a transport path for a sheet P, as shown in FIG. 8. The first switch gate G1 is provided in an area where the first sheet transport path R1 and the sixth sheet transport path R10 intersect with each other.

The first switch gate G1 switches (sets) the transport destination of a sheet P transported along the first sheet transport path R1 from any one of the first sheet feed device 410 to the third sheet feed device 430 (see FIG. 2) to either the first sheet transport path R1 or the fifth sheet transport path R8. Moreover, the first switch gate G1 switches the transport destination of a sheet P transported along the third sheet transport path R7 to either the first sheet transport path R1 or the fifth sheet transport path R8.

Figure 9A:
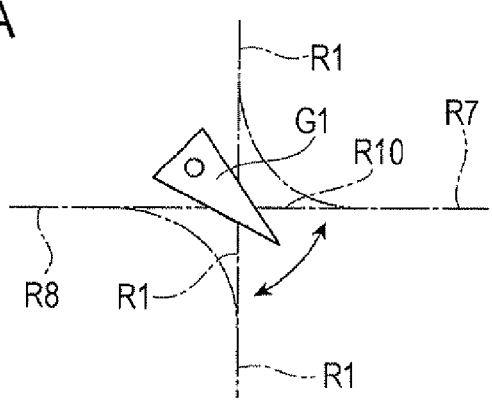
FIGS. 9A to 9D are diagrams explaining a sheet-transport-path switching mechanism.

More specifically, as shown in FIG. 9A, the first switch gate G1 includes a known drive mechanism (not shown), such as a solenoid. This drive mechanism is driven in response to a control signal received from the integrated controller 80 so that the first switch gate G1 may be set in one of three positions, that is, a first position, a second position, and a third position.

Figure 9B:
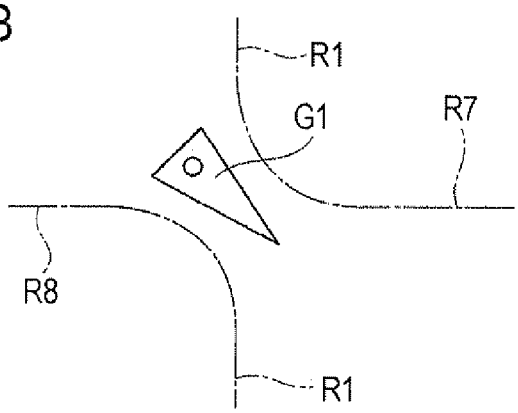

First, the first switch gate G1 set in the first position shown in FIG. 9B guides the sheet P transported along the third sheet transport path R7 toward the first sheet transport path R1. Moreover, the first switch gate G1 set in the first position guides the sheet P transported along the first sheet transport path R1 toward the fifth sheet transport path R8.

Figure 9C:
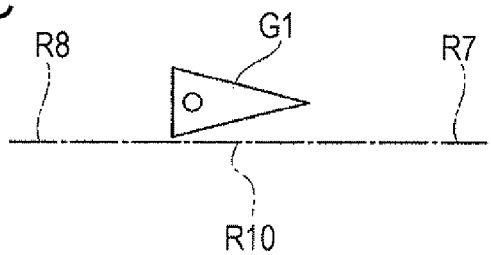

The first switch gate G1 set in the second position shown in FIG. 9C guides the sheet P transported along the third sheet transport path R7 toward the fifth sheet transport path R8.

Figure 9D:
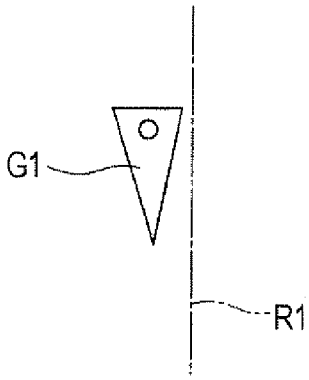

The first switch gate G1 set in the third position shown in FIG. 9D guides the sheet P transported along the first sheet transport path R1 continuously along the first sheet transport path R1 without switching the transport destination of the sheet P.

Controllers

Next, the configurations of the integrated controller 80, the feed controller 380, the transport controller 480, and the processing controller 580 will be described in detail.

Figure 10:
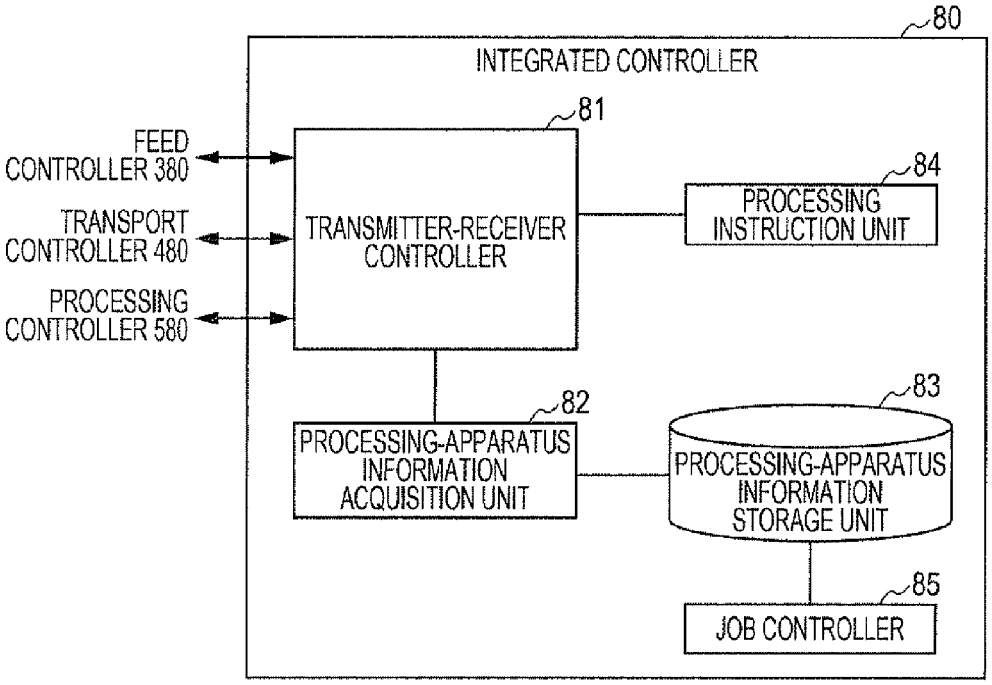
FIG. 10 illustrates a functional configuration of an integrated controller.

First, the integrated controller 80 will be described with reference to FIG. 10. FIG. 10 illustrates a functional configuration of the integrated controller 80.

The integrated controller 80 is realized by, for example, a processor that achieves its function by being controlled by a program, a nonvolatile memory that stores the program for controlling the processor, and a volatile memory used for, for example, data processing by the processor.

The integrated controller 80 includes a transmitter-receiver controller 81 that exchanges data with the feed controller 380, the transport controller 480, and the processing controller 580 (sometimes collectively referred to as "feed controller 380, etc." hereinafter), a processing-apparatus information acquisition unit 82 and a processing-apparatus information storage unit 83 that retain information related to the feed controller 380, etc., a processing instruction unit 84 that instructs processing to be executed by the sheet processing apparatus 5, and a job controller 85 that controls the operation of, for example, each device constituting the image forming apparatus 1.

The transmitter-receiver controller 81 is connected to the feed controller 380, etc. via a predetermined physical interface and exchanges data with the feed controller 380, etc. in accordance with a predetermined communication protocol.

The processing-apparatus information acquisition unit 82 receives information related to the sheet feed apparatus 3, the sheet transport apparatus 4, and the sheet processing apparatus 5 acquired from the feed controller 380, etc. via the transmitter-receiver controller 81 and stores the received information into the processing-apparatus information storage unit 83. The received information in this case includes identification information and functional information of the sheet feed apparatus 3, the sheet transport apparatus 4, and the sheet processing apparatus 5. The processing-apparatus information acquisition unit 82 transmits a request for acquiring the information related to the sheet feed apparatus 3, the sheet transport apparatus 4, and the sheet processing apparatus 5 to the feed controller 380, etc. at a predetermined timing.

The processing-apparatus information storage unit 83 is realized by, for example, a random access memory (RAM) and retains the information received by the processing-apparatus information acquisition unit 82.

The processing instruction unit 84 performs instruction, such as requesting information used for controlling the image forming apparatus 1 from the sheet processing apparatus 5. Furthermore, where appropriate, the processing instruction unit 84 is capable of instructing operations to be executed by the sheet feed apparatus 3, the sheet transport apparatus 4, and the sheet processing apparatus 5 to the feed controller 380, etc. on the basis of the information stored in the processing-apparatus information storage unit 83.

The job controller 85 controls a normal image forming operation in addition to performing control according to processing to be executed in accordance with the information stored in the processing-apparatus information storage unit 83 and the content of the instruction from the processing instruction unit 84.

Figure 11:
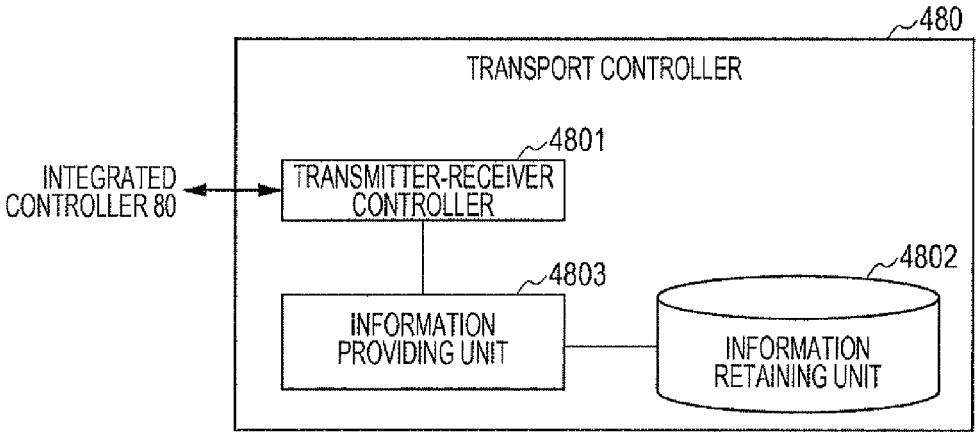
FIG. 11 illustrates a functional configuration of a transport controller.

Next, the transport controller 480 will be described with reference to FIG. 11. FIG. 11 illustrates a functional configuration of the transport controller 480.

The transport controller 480 is realized by, for example, a processor that achieves its function by being controlled by a program, a nonvolatile memory that stores the program for controlling the processor, and a volatile memory used for, for example, data processing by the processor.

The transport controller 480 includes a transmitter-receiver controller 4801 that exchanges data with the integrated controller 80, and an information retaining unit 4802 and an information providing unit 4803 that provide functional information of the sheet transport apparatus 4 to the integrated controller 80 of the image forming apparatus 1.

The transmitter-receiver controller 4801 is connected to the integrated controller 80 via a predetermined physical interface and exchanges data with the integrated controller 80 in accordance with a predetermined communication protocol.

The information retaining unit 4802 retains the identification information (ID) of the sheet transport apparatus 4 and information regarding what kind of function the sheet transport apparatus 4 has.

The information providing unit 4803 acquires the identification information and the functional information of the sheet transport apparatus 4 from the information retaining unit 4802 in accordance with an acquisition request for information received from the integrated controller 80 via the transmitter-receiver controller 4801 and transmits the information back to the integrated controller 80.

Although not described in detail, the feed controller 380 and the processing controller 580 have configurations similar to that of the transport controller 480 and transmit the identification information and functional information of the sheet feed apparatus 3 and the sheet processing apparatus 5 back to the integrated controller 80 in accordance with acquisition requests for information received from the integrated controller 80.

The integrated controller 80, the feed controller 380, the transport controller 480, and the processing controller 580 having the above-described configurations establish communication between the integrated controller 80 and the feed controller 380, etc. when, for example, power is supplied to the image forming system 100. Then, the integrated controller 80 receives the identification information from the feed controller 380, etc. so as to recognize apparatuses connected to the image forming apparatus 1.

As the integrated controller 80 recognizes that the sheet feed apparatus 3 is connected to the image forming apparatus 1, the integrated controller 80 recognizes that a sheet P onto which an image is to be formed is feedable from any one of the first sheet feed device 410 to the third sheet feed device 430 of the image forming apparatus 1 or any one of the fourth sheet feed device 440 to the sixth sheet feed device 460 of the sheet feed apparatus 3.

Then, when the integrated controller 80 receives a job from the PC (not shown) or via, for example, the UI 90, the integrated controller 80 determines whether a sheet P is to be fed from any one of the first sheet feed device 410 to the sixth sheet feed device 460 on the basis of the received job. This process of determining whether a sheet P is to be fed from any one of the sheet feed devices is performed by determining whether or not a sheet P having a size designated by the received job is retained in any one of the first sheet feed device 410 to the sixth sheet feed device 460.

If any one of the first sheet feed device 410 to the third sheet feed device 430 provided in the image forming apparatus 1 and any one of the fourth sheet feed device 440 to the sixth sheet feed device 460 provided in the sheet feed apparatus 3 have sheets P of the same size, for example, a sheet P may be fed from any one of the fourth sheet feed device 440 to the sixth sheet feed device 460 of the sheet feed apparatus 3 with higher priority. Accordingly, by using the fourth sheet feed device 440 to the sixth sheet feed device 460, which can retain a large number of sheets P, of the sheet feed apparatus 3, the frequency of resupplying sheets P may be reduced. Furthermore, by transporting a sheet P to the position adjuster 60 via a substantially linear segment that extends over a long distance from the corresponding second curve portion C2 to the position adjuster 60 rather than from the first curve portion C1, reduction in the accuracy of the positional adjustment by the position adjuster 60 may be further suppressed.

When a sheet P is to be fed from any one of the first sheet feed device 410 to the third sheet feed device 430 or when an image is to be formed on a second face of a sheet P having an image formed on a first face thereof, two paths used for transporting the sheet P can be provided. In other words, the two paths include a path (mode) used for transporting the sheet P via the seventh sheet feed path R43 connected to the sixth sheet feed path R41 in the sheet transport apparatus 4 and a path (mode) used for transporting the sheet P via the first sheet transport path R1 without transporting the sheet P through the sheet transport apparatus 4.

For example, the integrated controller 80 may switch the path used for transporting the sheet P in accordance with the length of the sheet P in the transport direction thereof. Specifically, if the sheet P is shorter than a predetermined length, the sheet P is transported without being transported through the sheet transport apparatus 4 since there is a low possibility that the trailing edge of the sheet P may extend over the curve portion C1.

In this case, when a sheet P is to be fed from any one of the first sheet feed device 410 to the third sheet feed device 430 to the second-transfer device 30 (i.e., when an image is to be formed on one face of the sheet P), the first switch gate G1 is set in the third position shown in FIG. 9D. When the sheet P transported along the third sheet transport path R7 is to be fed to the second-transfer device 30 (i.e., when an image is to be formed on the other face of the sheet P), the first switch gate G1 is set in the first position shown in FIG. 9B.

If the sheet P is long, the sheet P is fed via the sheet transport apparatus 4 since there is a higher possibility that the trailing edge of the sheet P may extend over the curve portion C1.

In this case, when a sheet P is to be fed from any one of the first sheet feed device 410 to the third sheet feed device 430 to the second-transfer device 30 (i.e., when an image is to be formed on one face of the sheet P), the first switch gate G1 is set in the second position shown in FIG. 9B. When the sheet P transported along the third sheet transport path R7 is to be fed to the second-transfer device 30 (i.e., when an image is to be formed on the other face of the sheet P), the first switch gate G1 is set in the second position shown in FIG. 9C.

With regard to a short sheet P, if the sheet P is to be transported without being transported through the sheet transport apparatus 4, the path therefor becomes shorter. In this case, the first copy output time (i.e., a time period from when a start button is pressed to when a first copy is output) is shortened.

Although not described above, the second curve portions C2 in the sheet transport apparatus 4 are gently curved and have a radius of curvature that is larger than that of the curve portion C1 provided in the image forming apparatus 1. The more gentle the curve of a path used for transporting a sheet P, the smaller the transport resistance of the sheet P. Furthermore, the transport resistance of the sheet P increases with increasing thickness of the sheet P. Thus, the integrated controller 80 controls the first switch gate G1 so that, when the thickness of the sheet P is smaller than a predetermined thickness, the sheet P is transported without being transported through the sheet transport apparatus 4. This is because, even if the trailing edge of the sheet P is located at the curve portion C1, the effect it has on the positional adjustment of the sheet P is limited. On the other hand, if the sheet P is thick, the sheet P may be fed via the sheet transport apparatus 4 since the effect on the positional adjustment of the sheet P is relatively large.

Modifications

In the above description, the integrated controller 80 receives identification information from the feed controller 380, etc. so as to recognize that the sheet feed apparatus 3, the sheet transport apparatus 4, or the sheet processing apparatus 5 is connected. Alternatively, for example, when the sheet feed apparatus 3 or the like is connected, a user's command regarding the identification of the sheet feed apparatus 3 or the like may be received via, for example, the UI 90. Furthermore, instead of providing the sheet feed apparatus 3, the sheet transport apparatus 4, or the sheet processing apparatus 5 with the feed controller 380, etc., the integrated controller 80 may be configured to control the entire image forming system 100.

Furthermore, the image forming system 100 may be formed by connecting the sheet transport apparatus 4 alone to the image forming apparatus 1, as described above. In order to increase the accuracy of positional adjustment of a sheet P in this configuration, the sheet P transported from the image forming apparatus 1 is temporarily fed to the sheet transport apparatus 4 and is subsequently transported to the image forming apparatus 1 again. On the other hand, if the output of sheets P is to be increased, the image forming operation may be performed in the image forming apparatus 1 without the intervention of the sheet transport apparatus 4.

In the above description, the image forming apparatus 1 of the image forming system 100 includes the first sheet feed device 410 to the third sheet feed device 430. Alternatively, if the sheet feed apparatus 3 is connected to the image forming apparatus 1, the first sheet feed device 410 to the third sheet feed device 430 may be removed such that sheets P are fed only from the sheet feed apparatus 3.

In the configuration in which the sheet feed apparatus 3 is directly connected to the image forming apparatus 1, as described above, if the accuracy of the positional adjustment by the position adjuster 60 is to be further enhanced, the sheet transport apparatus 4 may be considered as a configuration provided between the image forming apparatus 1 and the sheet feed apparatus 3. By providing the sheet transport apparatus 4 between the image forming apparatus 1 and the sheet feed apparatus 3, the substantially linear segment extending from each second curve portion C2 to the position adjuster 60 is extended, so that the accuracy of the positional adjustment by the position adjuster 60 may be further enhanced, as mentioned above.

Furthermore, the selection for whether or not to provide the sheet transport apparatus 4 between the image forming apparatus 1 and the sheet feed apparatus 3 may be made on the basis of whether to prioritize improved sheet versatility or the space occupied by the image forming system 100 in accordance with the convenience of the user using the image forming system 100.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

a sheet feed apparatus that feeds a sheet;

an image forming apparatus that is provided independently of the sheet feed apparatus and that includes an image-formation transport path used for transporting the sheet fed from the sheet feed apparatus and an image forming section that forms an image onto the sheet transported along the image-formation transport path; and a relay apparatus that is independently provided between the sheet feed apparatus and the image forming apparatus, the relay apparatus relaying the sheet fed from the sheet feed apparatus toward the image forming apparatus and ensuring a distance along which the sheet is transported from the sheet feed apparatus to the image forming apparatus, the relay apparatus including:

a first receiving section that receives a sheet fed from the sheet feed apparatus;

a first transport path that is used for transporting the sheet received by the first receiving section;

a discharge section that is provided at an opposite side of the first receiving section in the relay apparatus and that discharges the sheet toward the image forming apparatus having the image forming section that forms an image onto the sheet transported via the first transport path;

a second receiving section that is provided at a discharge-section side in the relay apparatus and that receives the sheet from the image forming apparatus; and a second transport path that is connected to the first transport path and that transports the sheet received by the second receiving section to the image forming apparatus via the first transport path, wherein the first transport path has a straight portion between (i) a connection point where the second transport path connects to the first transport path, and (ii) the discharge section, the straight portion being longer than a portion between the first receiving section and the connection point, wherein the sheet feed apparatus is configured to be able to be connected directly to the image forming apparatus without an intervention of the relay apparatus.

2. The image forming system according to claim 1, wherein the sheet feed apparatus includes a sheet transport path that transports the sheet, the sheet transport path including a curved portion.

3. The image forming system according to claim 1, wherein the image forming apparatus includes a receiving section that receives the sheet transported from the sheet feed apparatus, and a position adjuster that is provided between the receiving section and a location where the image is to be formed onto the sheet by the image forming section and that adjusts a position of the sheet in a direction intersecting a sheet transport direction.

4. The image forming system according to claim 1, wherein the image forming apparatus includes an accommodation section that accommodates a plurality of sheets, and wherein the relay apparatus includes a relay transport path used for transporting the sheet from the sheet feed apparatus to the image forming apparatus and a receiving section that receives each sheet transported from the accommodation section of the image forming apparatus, the relay apparatus transporting the sheet received by the receiving section toward the image forming apparatus via the relay transport path.

5. The image forming system according to claim 4, wherein the image forming apparatus includes a switching unit that switches between a transport mode in which each sheet accommodated in the accommodation section of the image forming apparatus is discharged from the image forming apparatus and is transported to the image forming section via the relay apparatus and a transport mode in which each sheet accommodated in the accommodation section of the image forming apparatus is transported to the image forming section without being discharged from the image forming apparatus.

6. The image forming system according to claim 5, wherein the switching unit switches the transport mode in which each sheet accommodated in the accommodation section of the image forming apparatus is transported without being discharged from the image forming apparatus when a length of the sheet is shorter than a predetermined length, and the switching unit switches the transport mode in which each sheet accommodated in the accommodation section of the image forming apparatus is discharged from the image forming apparatus and is transported to the image forming section via the relay apparatus when the length of the sheet is equal to or longer than the predetermined length.

7. A relay apparatus comprising:

a first receiving section that receives a sheet fed from a sheet feed apparatus;

a first transport path that is used for transporting the sheet received by the first receiving section;

a discharge section that is provided at an opposite side of the first receiving section in the relay apparatus and that discharges the sheet toward an image forming apparatus having an image forming section that forms an image onto the sheet transported via the first transport path;

a second receiving section that is provided at a discharge-section side in the relay apparatus and that receives the sheet from the image forming apparatus; and a second transport path that is connected to the first transport path and that transports the sheet received by the second receiving section to the image forming apparatus via the first transport path, wherein the first transport path has a straight portion between (i) a connection point where the second transport path connects to the first transport path, and (ii) the discharge section, the straight portion being longer than a portion between the first receiving section and the connection point.

* * * * *